US006655930B2

(12) United States Patent
Sato et al.

(10) Patent No.: US 6,655,930 B2
(45) Date of Patent: Dec. 2, 2003

(54) INSULATION MEANS FOR A CENTRIFUGAL PUMP

(75) Inventors: Hitoshi Sato, Tokyo (JP); Motoyasu Ogawa, Tokyo (JP); Masatake Hattori, Tokyo (JP)

(73) Assignee: Nikkiso Co., Ltd., Tokyo (JP)

( * ) Notice: Subject to any disclaimer, the term of this patent is extended or adjusted under 35 U.S.C. 154(b) by 57 days.

(21) Appl. No.: 10/025,358

(22) Filed: Dec. 19, 2001

(65) Prior Publication Data

US 2002/0114714 A1 Aug. 22, 2002

(30) Foreign Application Priority Data

Feb. 21, 2001 (JP) ..... 2001-045302

(51) Int. Cl.[7] ..... F04B 35/04

(52) U.S. Cl. ..... 417/373; 417/423.8; 417/901; 62/50.6

(58) Field of Search ..... 417/373, 424.1, 417/423.8, 423.11, 901; 415/177; 62/55.5, 50.6

(56) References Cited

U.S. PATENT DOCUMENTS 3,453,964 A * 7/1969 Hallworth ..... 417/360
3,744,935 A * 7/1973 Magni ..... 417/370
4,593,835 A * 6/1986 Kikkawa et al. ..... 62/50.6
5,242,285 A 9/1993 Westermann, Jr.
5,604,777 A * 2/1997 Raymond et al. ..... 376/310
6,213,736 B1 4/2001 Weisser

OTHER PUBLICATIONS

Product Specification from www/acdcom.com/tc–34.pdf of Bulletin No ACD TC340R!99, printed Apr. 5, 2002, 2–pages.

* cited by examiner

*Primary Examiner*—Cheryl J. Tyler
(74) *Attorney, Agent, or Firm*—Darby & Darby

(57) ABSTRACT

A centrifugal pump for pumping low temperature fluid includes a motor portion driving an impeller of a pump portion. The motor portion and impeller are coaxial. A pot, sealed to the pump portion, receives the low temperature fluid. The low temperature fluid contacts only the pump portion in the pot, thereby reducing the overall heat capacity of the centrifugal pump to reduce start time. A heat insulating jacket is in tight contact with the motor portion. A vent pipe extends from the pot, through the pump portion and within the heat insulating jacket, to a rear of the motor portion to increase safety and provide double-insulation to the vent pipe. The heat insulating jacket reduces the size and surface area of the centrifugal pump to resist heat flow and increase safety.

13 Claims, 2 Drawing Sheets

INSULATION MEANS FOR A CENTRIFUGAL PUMP

BACKGROUND TO THE INVENTION

1. Field of the Invention

The present invention relates to a centrifugal pump for handling liquefied gases and very low temperature fluids. More specifically, the present invention relates to a centrifugal pump including a pump with an impeller, and a motor for driving the impeller.

2. Description of the Related Art

Specialized pumps exist for handling low temperature fluids such as liquefied natural gas, liquefied petroleum gas, and other liquified gases. In general, these pumps each include a pump portion and a motor portion. The pump portion includes an impeller which imparts speedy motion to the fluid. The motor includes an electric motor which operates the impeller.

Since the operating temperatures for these specialized pumps are very low, it is necessary to adequately insulate the inside and outside of the pump and take other steps to minimize heating effects. For this reason, an insulating jacket typically surrounds these specialized pumps in an attempt to provide adequate heat insulation. Many of these insulating jackets operate ineffectively as well as detrimentally increase the size of the pump.

To assist heat insulation, it is preferable to have a pump with a small surface area. When starting the pump, it is necessary to have adequate cooling of the pump temperature so that the low temperature fluid does not inappropriately volatilize. Thus, a pump with a small heat capacity is needed for speedy cooling. The known pumps have high heat capacity and therefore provide ineffective and slow cooling prior to operation.

OBJECTS AND SUMMARY OF THE INVENTION

It is an object of the present invention to provide a pump which overcomes the drawbacks of the related art noted above.

It is another object of the present invention to provide an efficient centrifugal pump.

It is another object of the present invention to provide a pump which easily handles very low temperature fluids.

It is another object of the present invention to provide a pump which includes adequate heat insulation and has a small heat capacity.

It is another object of the present invention to provide a pump with a speedy start up.

The present invention relates to a centrifugal pump including a motor portion and a pump portion. The motor portion, which is coaxial with the pump portion, drives an impeller to pump a low temperature fluid. A pot is sealed to the pump portion to receive the low temperature fluid. The low temperature fluid contacts only the pump portion in the pot to thereby reduce the overall heat capacity of the centrifugal pump and thus reduce start time. A heat insulating jacket is in tight contact with the motor portion. A vent pipe extends from the pot, through the pump portion and within the heat insulating jacket, to a rear of the motor portion to increase safety and provide double-insulation to the vent pipe. The heat insulating jacket reduces the size and surface area of the centrifugal pump to resist heat flow and increase safety.

According to an embodiment of the present invention there is provided a centrifugal pump, for pumping a low temperature fluid, comprising: a pump portion, a motor portion on the pump portion, the pump portion including an impeller having a first rotation axis, the motor portion including a motor having a second rotation axis, the first rotation axis in coaxial alignment with the second rotation axis, the motor driving the impeller during an operation of the centrifugal pump to drive the pump portion and pump the low temperature fluid, insulating jacket means for thermally insulating at least the motor portion, the insulating jacket means surrounding at least the motor portion, at least a first vacuum jacket in the insulating jacket means, and the first vacuum jacket including at least a low pressure vacuum between a motor outer surface and an inner surface of the first vacuum jacket, whereby tight contact between the insulating jacket means and the motor portion and the coaxial alignment provides increased thermal efficiency, reduced size, and simplified construction.

According to another embodiment of the present invention there is provided a centrifugal pump, further comprising: a pot, the pot sealed around a lower portion of the pump portion, the pot solely receiving the low temperature fluid during the operation, an intake pipe in the lower portion extending away the pump portion along the first rotation axis into the pot, the intake pipe and the impeller in fluid communication, and the intake pipe and the impeller transporting the low temperature fluid from the pot during the operation, thereby restricting direct contact of the low temperature fluid to the pump portion and providing a reduced pump surface area with an improved startability.

According to another embodiment of the present invention there is provided a centrifugal pump, further comprising: a flow straightening plate, the flow straightening plate in the pot opposite the intake pipe, and the flow straightening plate having a shape preventing formation of a rotational flow of the low temperature fluid in the pot during the operation.

According to another embodiment of the present invention there is provided a centrifugal pump, further comprising: a release pipe, the release pipe in sealed communication between the motor portion and an external portion of the centrifugal pump, and the release pipe providing an easy release of any the low temperature fluid and a vapor of the low temperature fluid which has improperly entered the motor portion, thereby increasing reliability of the centrifugal pump.

According to another embodiment of the present invention there is provided a centrifugal pump, further comprising: a vent pipe, the vent pipe in vapor communication between the pot and the release pipe, and at least a first portion of the vent pipe within the first vacuum jacket, whereby the first vacuum jacket provides easy double-service thermal insulation of the motor portion and the vent pipe to reduce size while increasing safety.

According to another embodiment of the present invention there is provided a centrifugal pump, wherein: the release pipe extends from a rear side of the motor portion away from the first vacuum jacket.

According to another embodiment of the present invention there is provided a centrifugal pump, wherein: the at least a first portion of the vent pipe includes the entire vent pipe, whereby the first vacuum jacket provides easy double-insulation of the motor portion and the entire vent pipe while reducing size and increasing safety.

According to another embodiment of the present invention there is provided a centrifugal pump, wherein: at least the first portion of the vent pipe is greater that one half of an overall length of the vent pipe, whereby the first vacuum jacket provides easy double-insulation of the motor portion and the first portion while reducing size and increasing safety.

According to another embodiment of the present invention there is provided a centrifugal pump, wherein: the flow straightening plate includes at least a first and a second plate extending away from a bottom of the pot toward the intake pipe, and the first and the second plates perpendicular to each other.

According to another embodiment of the present invention there is provided a centrifugal pump, further comprising: a front end partitioning wall between the motor portion and the pump portion, a rear end partitioning wall on the motor portion opposite the front end partitioning wall, and the motor portion sealed between the front end partitioning wall and the rear end partitioning wall thereby separating the motor portion from the first vacuum jacket and allowing easy creation of the first vacuum jacket.

According to another embodiment of the present invention there is provided a centrifugal pump, wherein: the release pipe is in sealed communication between the rear end partitioning wall on motor portion and an external portion of the centrifugal pump.

According to another embodiment of the present invention there is provided a centrifugal pump, further comprising: at least a second vacuum jacket in the insulating jacket means, and the second vacuum jacket including at least a low pressure vacuum between a pot outer surface and an inner surface of the second vacuum jacket, whereby tight contact between the insulating jacket means and the pot and coaxial alignment provides increased thermal efficiency, smaller size, and simplified construction.

According to another embodiment of the present invention there is provided a centrifugal pump, for pumping a low temperature fluid, comprising: a pump portion, a motor portion on the pump portion, the pump portion including an impeller having a first rotation axis, the motor portion including a motor having a second rotation axis, the motor driving the impeller during an operation of the centrifugal pump to drive the pump portion and pump the low temperature fluid, the first rotation axis coaxial with the second rotation axis, insulating jacket means for thermally insulating at least the motor portion, the insulating jacket means surrounding at least the motor portion, at least a first vacuum jacket in the insulating jacket means, the first vacuum jacket including at least a low pressure vacuum between a motor outer surface and an inner surface of the first vacuum jacket, whereby tight contact between the insulating jacket means and the motor portion and coaxial alignment provides increased thermal efficiency, reduced size, and simplified construction, a pot, the pot sealed around a lower portion of the pump portion, the pot solely receiving the low temperature fluid during the operation, an intake pipe in the lower portion extending away the pump portion along the first rotation axis into the pot, the intake pipe and the impeller in fluid communication, the intake pipe and the impeller transporting the low temperature fluid from the pot during the operation and restricting direct contact of the low temperature fluid to the pump portion thereby providing a reduced pump surface area and an improved startability, a release pipe, the release pipe in sealed communication between the motor portion and an external portion of the centrifugal pump, the release pipe providing an release of any of the low temperature fluid and a vapor of the low temperature fluid which has improperly entered the motor portion, a vent pipe, the vent pipe in vapor communication between the pot and the release pipe, and at least a first portion of the vent pipe is located within the first vacuum jacket, whereby the first vacuum jacket provides easy double-service thermal insulation of the motor portion and the vent pipe.

According to another embodiment of the present invention there is provided a centrifugal pump, for pumping a low temperature fluid, comprising: a pump portion, a motor portion on the pump portion, an impeller in the pump portion, a motor in the motor portion driving the impeller during an operation of the centrifugal pump and pumping the low temperature fluid, the motor portion is coaxial with the impeller, a heat insulating jacket on the centrifugal pump, and the heat insulating jacket including a first insulating portion in tight contact around the motor portion, thereby reducing the centrifugal pump in size while increasing thermal efficiency.

The above, and other objects, features, and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
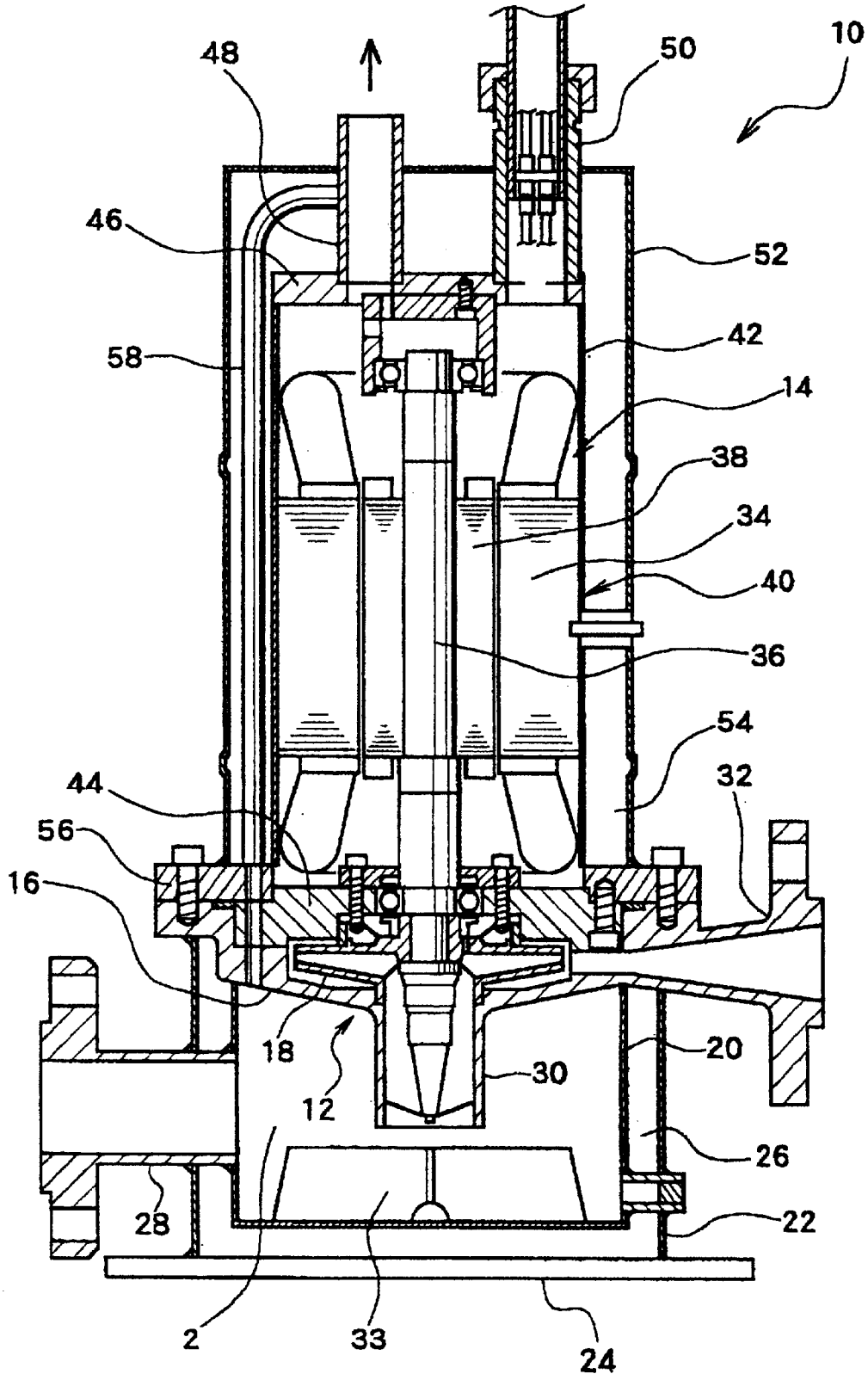
FIG. 1 shows a schematic diagram of a centrifugal pump according to an embodiment of the present invention.

Referring now to FIG. 1, a centrifugal pump 10 is primarily divided into a pump portion 12 and a motor portion 14. Motor portion 14 drives pump portion 12, as will be described. Pump portion 12 includes an impeller 18 which rotates inside a casing 16. Pump portion 12 is beneficially positioned inside a pot 20, as will be explained.

Pot 20 is surrounded on three sides by a lower outer cylinder 22 and a bottom plate 24. A bottom section (not shown) of outer cylinder 22 is sealed to bottom plate 24. Casing 16 is joined to and sealed to pot 20. During assembly, a lower vacuum jacket 26 is constructed by reducing the pressure in the space between pot 20, lower outer cylinder 22, and bottom plate 24. Lower vacuum jacket 26 provides beneficial heat insulation to pump portion 12 while easily allowing for reduced size, as will be explained. Lower outer cylinder 22 has a predetermined and specified spacing away from pot 20.

An inlet pipe 28 provides sealed fluid access to pot 20. During operation, inlet pipe 28 transports the fluid to be handled (i.e., a very low temperature fluid) into a fluid container portion 2 inside pot 20.

An intake pipe 30 extends away from pump portion 12 toward fluid container portion 2 in pot 20. Intake pipe 30 aids in pumping the low temperature fluid collected inside pot 20 to a discharge pipe 32. During operation, impeller 18, in pump portion 12, draws the low temperature fluid into intake pipe 30 and discharges the low temperature fluid out discharge pipe 32. Intake pipe 30 and impeller 18 are both located in casing 16.

A straightening plate 33 is disposed below intake pipe 30 in pot 20. Straightening plate 33 includes multiple plates designed and arranged to prevent the formation of circling flow inside pot 20 during use. In the present embodiment, the plates in straightening plate 33 are cross-shaped plates which extend perpendicular to intake pipe 30. One skilled in the art will readily recognize that alternative embodiments of the instant invention may include additional or different arrangement of the cross-shaped plates or the use of different designs and baffles at different angles to prevent circling flow Motor portion 14 includes an electric motor 40 having a stator 34 and a rotor 38. Rotor 38 is unitarily formed with a rotor shaft 36 inside stator 34. Rotor shaft 36 extends away from motor portion 14 to pump portion 12 where it is affixed to an end of impeller 18. During operation, rotor shaft 36 transmits torque from motor portion 14 to pump portion 12 to pump the low temperature fluid.

Electric motor 40 is sealed inside a motor outer cylinder 42, as will be explained. Motor outer cylinder 42 is in close contact on the outer perimeter of stator 34. A set of front and a rear end partitioning walls 44, 46 seal and close both ends of motor outer cylinder 42.

Front end partitioning wall 44 is a partitioning wall on a pump portion side of electric motor 40. Front end partitioning wall 44 is a part of casing 16 in pump portion 12. Rear end partitioning wall 46 is opposite front end partitioning wall 44 in electric motor 40.

A fluid release pipe 48 joins to a back end of motor 40 to release any low temperature fluid that has undesirably entered motor portion 14. A power line duct 50 is joined to the back end of motor 40. Power line duct 50 receives power lines (not shown) for transmission of power to the coils of stator 34. Fluid release pipe 48 and power line duct 50 are sealed to rear end partitioning wall 46 opposite pump portion 12.

An upper outer cylinder 52 surrounds motor outer cylinder 42 and back end partitioning wall 46. Upper outer cylinder 52 is sealed to a flange 56 on a pump side end, and to an outer surface of power line duct 50 and to fluid release pipe 48. Flange 56 is sealed to casing 16 during assembly. Upper outer cylinder 52 has a predetermined and specified spacing away from motor outer cylinder 42.

During assembly, an upper vacuum jacket 54 is formed by reducing the pressure between upper outer cylinder 52 and motor outer cylinder 42. Upper vacuum jacket 54 provides simple heat insulation in a minimum space with efficient parts usage.

A vent pipe 58 extends through casing 16, inside upper vacuum jacket 54, to fluid release pipe 48. Vent pipe 58 provides a sealed release path to release low temperature fluid that has vaporized inside pot 20.

Upper vacuum jacket 54 is in close contact with the outer perimeter of motor portion 14. This positioning provides desirable design and space benefits because the outer diameter of upper vacuum jacket 54, (the outer diameter of upper outer cylinder 52) is small. This reduction in size correspondingly reduces the overall centrifugal pump 10 surface area. One particular benefit of the present invention is the use of motor portion 14 itself as an integral part of the insulating system of centrifugal pump 10.

The external shape of centrifugal pump 10 both easily accommodates and protects vent pipe 58 inside upper vacuum jacket 54 thus providing further size reduction and safety. The position of vent pipe 58 within upper vacuum jacket 54 provides easy double-service heat insulation without additional equipment.

Casing 16 serves in part as a partitioning wall between pump portion 12 and motor portion 14.

During operation, low temperature fluid accumulates in pot 20 before being suctioned into pump portion 12. Pot 20 is solely around pump portion 12, below casing 16, and is sealed to casing 16. This beneficially reduces minimum pot 20 capacity and increases efficiency and speed of centrifugal pump 10, as will be explained.

Figure 2:
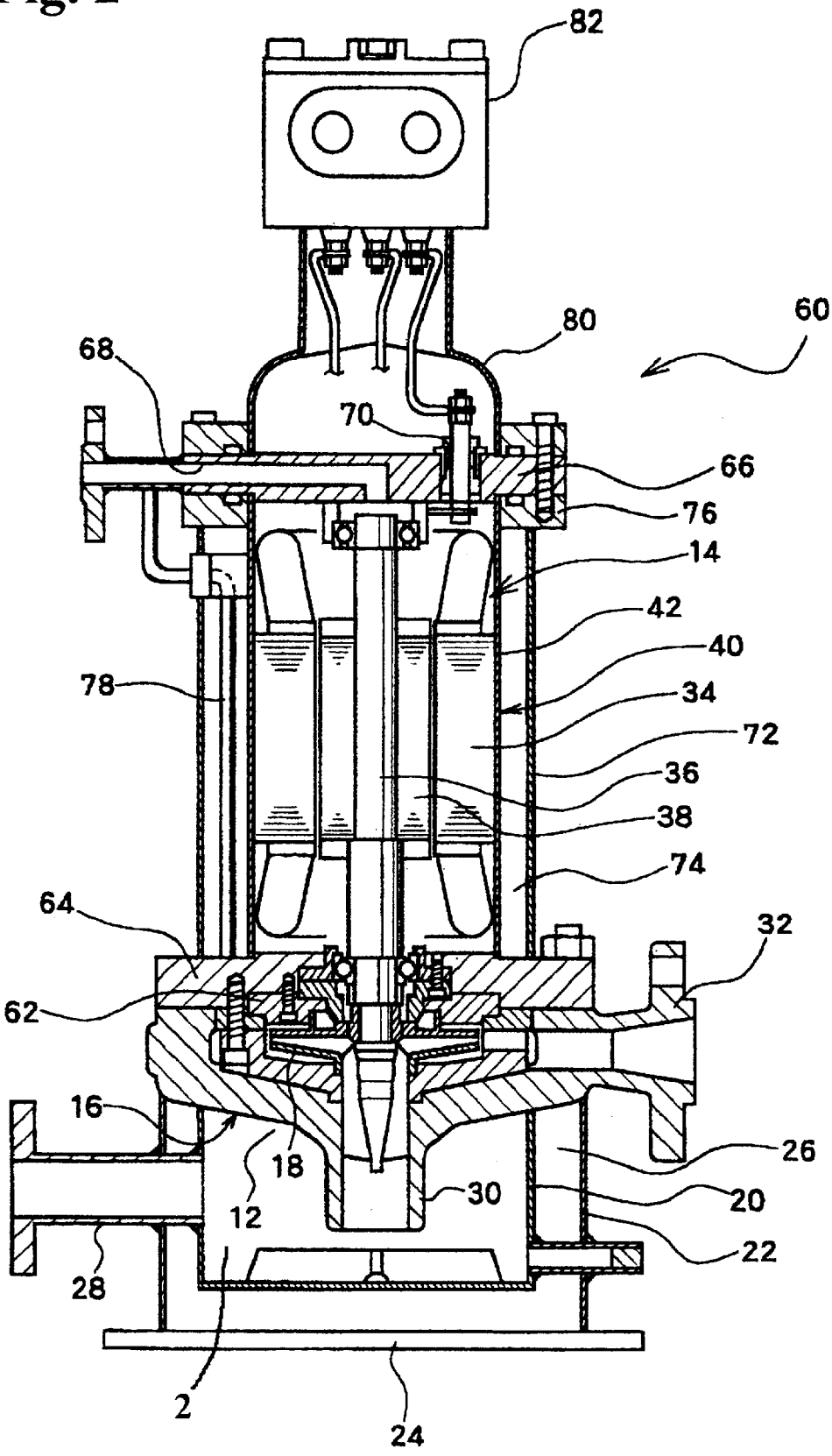
FIG. 2 shows a schematic diagram of a centrifugal pump according to another embodiment of the present invention.

Since pot 20 surrounds only pump portion 12, pot 20 limits low temperature fluid contact solely to pump portion 12. This beneficially limits the portion of pump portion 12 that must be cooled prior to start. In other words, this reduction in size correspondingly reduces the heat capacity (thermal mass) of the portion of pump portion 12 that must be cooled by the low temperature fluid prior to starting. The reduction in heat capacity allows cooling to an operable temperature of pump portion 12. One skilled in the instant art will therefore understand that by limiting the direct contact of low temperature fluid to only pump portion 12, the 'startability' (speed-to-start time) of pump portion 12 is improved Referring now to FIG. 2, an alternative embodiment of the present invention includes a centrifugal pump 60 having electric motor 40. Motor outer cylinder 42 closely surrounds electric motor 40. A front and a back end partitioning wall 64, 66 close and seal both ends of motor outer cylinder 42, as will be explained.

A casing back surface 62 separates pump portion 12 and motor portion 14 in centrifugal pump 60. Front end partitioning wall 64 also serves as a partitioning wall on the pump portion 12 side of electric motor 40. Front end partitioning wall 64 is sealed to casing back surface 62 and divides and separately secures pump portion 12 and motor portion 14. Pump portion 12 is located below casing 16.

A fluid release pipe 68 extends through back end partitioning wall 66, as will be explained. One end of fluid release pipe 68 opens at a surface on electric motor 40, and from there, fluid release pipe 68 extends radially toward a side surface of centrifugal pump 60. Fluid release pipe 68 allows beneficial release of low temperature fluid which has entered motor portion 14.

A through hole 70 allows sealed power line access through back end partitioning wall 66 to the coil of stator 34. The power line provides operational power to electric motor 40 to drive pump portion 12.

Motor outer cylinder 42 closely surrounds motor 40 and is sealed to respective front and back end partitioning walls 64, 66. An upper outer cylinder 72 surrounds outer cylinder 42 at a predetermined spacing. A lower end of upper outer cylinder 72 is sealed to front end partitioning wall 64. An upper end of upper outer cylinder 72 is sealed to a flange 76. Flange 76 is sealed to and extends from an upper end of motor outer cylinder 42.

An upper vacuum jacket 74 is created by depressurizing the space between motor outer cylinder 42 and upper outer cylinder 72. Upper vacuum jacket 74 provides beneficial thermal (heat) insulation to centrifugal pump 60 within a minimal space, as noted above.

A vent pipe 78 passes through casing 16 and front end partitioning wall 64 and extends inside upper vacuum jacket 74 to a back end of motor portion 14. Vent pipe 78 exits upper vacuum jacket 74 before reaching back end partitioning wall 66 where it joins fluid release pipe 68. Vent pipe 78 releases vaporized low temperature fluid from inside pot 20.

An end cap 80 extends above end partitioning wall 66. A terminal box 82 is fixed to an upper end of end cap 80. Terminal box 82 includes an external power supply terminal which links an external power supply to the power cables passing through end cap 80 and through hole 70 to electric motor 40. To additionally aid thermal insulation of motor portion 14, end cap 80 may retain a vacuum adjacent back end partitioning wall 66.

As with the previous embodiment, upper vacuum jacket 74 tightly contacts an outer perimeter of motor portion 14. This beneficial design reduces the outer diameter of upper outer cylinder 72 and reduces the overall surface area of centrifugal pump 60. Vent pipe 78 both receives beneficial thermal (heat) insulation from upper vacuum jacket 74 and also contributes to the reduction in overall surface area of centrifugal pump 60.

As with the embodiment described above, before operating centrifugal pump 60, low temperature fluid accumulates in pot 20 before being suctioned into pump portion 12. Pot 20 is only around pump portion 12 below casing 16 and is sealed to casing 16. This reduces minimum pot 20 capacity and increases efficiency and speed of centrifugal pump 10, as will be explained.

Since pot 20 surrounds only pump portion 12, pot 20 limits low temperature fluid contact to pump portion 12, and the design beneficially limits the portion of pump portion 12 that must be cooled prior to start. This reduction in size correspondingly reduces the heat capacity of the portion of pump portion 12 that must be by the low temperature fluid prior to start-up. The reduction in heat capacity allows a faster cooling of pump portion 12 to an operable temperature. One skilled in the instant art will therefore understand that by limiting the direct contact of low temperature fluid to pump portion 12, the 'startability' of pump portion 12 is improved and increased in speed.

As will be understood by a reader skilled in the art, the embodiments presented above provide multiple benefits, particularly in the areas of reduced pump size, faster pump start speed (startability), increased thermal efficiency, faster vapor recovery, and construction simplicity.

Although only a single or few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included within the spirit and scope of this invention as defined in the following claims. In the claims, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies entirely on friction between a wooden part and a cylindrical surface, a screw's helical surface positively engages the wooden part, and a bolt's head and nut compress opposite sides of at least one wooden part, in the environment of fastening wooden parts, a nail, a screw, and a bolt may be readily understood by those skilled in the art as equivalent structures.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A centrifugal pump, for pumping a low temperature fluid, comprising:

a pump portion;

a motor portion on said pump portion;

said pump portion comprising an impeller having a first rotation axis;

said motor portion comprising a motor having a second rotation axis;

said first rotation axis being coaxial with said second rotation axis;

said motor being connected for driving said impeller during operation of said centrifugal pump to drive said pump portion and pump said low temperature fluid;

an insulating jacket means for thermally insulating at least said motor portion;

said insulating jacket means surrounding at least said motor portion;

at least a first vacuum jacket in said insulating jacket means;

said first vacuum jacket comprising at least a low pressure vacuum between a motor outer surface and an inner surface of said first vacuum jacket, whereby tight contact between said insulating jacket means and said motor portion and said coaxial alignment provides increased thermal efficiency, reduced size, and simplified construction;

a pot;

said pot being sealed around a lower portion of said pump portion;

said pot solely receiving said low temperature fluid during said operation;

an intake pipe in said lower portion extending away from said pump portion along said first rotation axis into said pot;

said intake pipe and said impeller being in fluid communication; and said intake pipe and said impeller transporting said low temperature fluid from said pot during said operation, thereby restricting direct contact of said low temperature fluid to said pump portion and providing a reduced pump surface area with an improved startability.

2. A centrifugal pump, according to claim 1, further comprising:

a flow straightening plate;

said flow straightening plate being disposed in said pot opposite said intake pipe; and said flow straightening plate having a shape effective for preventing formation of a rotational flow of said low temperature fluid in said pot during said operation.

3. A centrifugal pump, according to claim 2, wherein:

said flow straightening plate comprises at least a first and a second plate extending away from a bottom of said pot toward said intake pipe; and said first and said second plates are perpendicular to each other.

4. A centrifugal pump, according to claim 2, further comprising:

a release pipe;

said release pipe being in sealed communication between said motor portion and an external portion of said centrifugal pump; and said release pipe providing an easy release of any portion of said low temperature fluid and a vapor of said low temperature fluid from said motor portion, thereby increasing reliability of said centrifugal pump.

5. A centrifugal pump, according to claim 4; further comprising:

a vent pipe;

said vent pipe being in vapor communication between said pot and said release pipe; and at least a first portion of said vent pipe is located within said first vacuum jacket, whereby said first vacuum jacket provides double-service thermal insulation of said motor portion and said vent pipe to reduce size while increasing safety.

6. A centrifugal pump, according to claim 5, wherein said release pipe extends from a rear side of said motor portion away from said first vacuum jacket.

7. A centrifugal pump, according to claim 6, wherein said at least a first portion of said vent pipe comprises said entire vent pipe, whereby said first vacuum jacket provides easy double-insulation of said motor portion and said entire vent pipe while reducing size and increasing safety.

8. A centrifugal pump, according to claim 6, wherein at least said first portion of said vent pipe is greater than one half of an overall length of said vent pipe, whereby said first vacuum jacket provides easy double-insulation of said motor portion and said first portion while reducing size and increasing safety.

9. A centrifugal pump, according to claim 6, further comprising:

a front end partitioning wall between said motor portion and said pump portion;

a rear end partitioning wall on said motor portion opposite said front end partitioning wall; and said motor portion is sealed between said front end partitioning wall and said rear end partitioning wall thereby separating said motor portion from said first vacuum jacket and allowing creation of said first vacuum jacket.

10. A centrifugal pump, according to claim 9, wherein said release pipe is in sealed communication between said rear end partitioning wall on said motor portion and an external portion of said centrifugal pump.

11. A centrifugal pump, according to claim 6, further comprising:

at least a second vacuum jacket in said insulating jacket means; and said second vacuum jacket comprising at least a low pressure vacuum between a pot outer surface and an inner surface of said second vacuum jacket, whereby tight contact between said insulating jacket means and said pot and coaxial alignment provides increased thermal efficiency, smaller size, and simplified construction.

12. A centrifugal pump, for pumping a low temperature fluid, comprising:

a pump portion;

a motor portion on said pump portion;

said pump portion comprising an impeller having a first rotation axis;

said motor portion comprising a motor having a second rotation axis;

said motor driving said impeller during an operation of said centrifugal pump to drive said pump portion and pump said low temperature fluid;

said first rotation axis being coaxial with said second rotation axis;

insulating jacket means for thermally insulating at least said motor portion;

said insulating jacket means surrounding at least said motor portion;

at least a first vacuum jacket in said insulating jacket means;

said first vacuum jacket comprising at least a low pressure vacuum between a motor outer surface and an inner surface of said first vacuum jacket, whereby tight contact between said insulating jacket means and said motor portion and coaxial alignment provides increased thermal efficiency, reduced size, and simplified construction;

a pot;

said pot being sealed around a lower portion of said pump portion;

said pot solely receiving said low temperature fluid during said operation;

an intake pipe in said lower portion extending away said pump portion along said first rotation axis into said pot;

said intake pipe and said impeller being in fluid communication;

said intake pipe and said impeller transporting said low temperature fluid from said pot during said operation and limiting direct contact of said low temperature fluid with said pump portion thereby providing a reduced pump surface area and an improved startability;

a release pipe in sealed communication between said motor portion and an external portion of said centrifugal pump;

said release pipe providing an release of any of said low temperature fluid and a vapor of said low temperature fluid which has improperly entered said motor portion;

a vent pipe in vapor communication between said pot and said release pipe; and at least a first portion of said vent pipe being disposed within said first vacuum jacket, whereby said first vacuum jacket provides easy double-service thermal insulation of said motor portion and said vent pipe.

13. A centrifugal pump, for pumping a low temperature fluid, comprising:

a pump portion;

a motor portion on said pump portion;

an impeller in said pump portion having a first rotation axis;

a motor in said motor portion driving said impeller during an operation of said centrifugal pump and pumping said low temperature fluid;

said motor portion being coaxial with said impeller;

a heat insulating jacket on said centrifugal pump;

said heat insulating jacket comprising a first insulating portion in tight contact around said motor portion; thereby reducing said centrifugal pump in size while increasing thermal efficiency;

a pot;

said pot being sealed around a lower portion of said pump portion;

said pot solely receiving said low temperature fluid during said operation;

an intake pipe in said lower portion extending away from said pump portion along said first rotation axis into said pot;

said intake pipe and said impeller being in fluid communication; and said intake pipe and said impeller transporting said low temperature fluid from said pot during said operation, thereby restricting direct contact of said low temperature fluid to said pump portion and providing a reduced pump surface area with an improved startability.

* * * * *